US006353281B2

(12) United States Patent
Sugiyama et al.

(10) Patent No.: US 6,353,281 B2
(45) **Date of Patent: *Mar. 5, 2002**

(54) CATHODE RAY TUBE

(75) Inventors: Mitsuhiro Sugiyama, Chiba-ken; Tsutomu Tojyo; Masahiro Ito, both of Mobara; Masayoshi Misono, Chiba-ken; Hiroyuki Tamura, Chiba, all of (JP)

(73) Assignees: Hitachi, Ltd., Tokyo; Hitachi Device Engineering, Co., Ltd.; Hitachi Electronic Devices Co., Ltd., both of Mobara (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/833,558

(22) Filed: Apr. 13, 2001

Related U.S. Application Data

(63) Continuation of application No. 09/460,517, filed on Dec. 14, 1999, now Pat. No. 6,232,711.

(30) Foreign Application Priority Data

Dec. 15, 1998 (JP) ..... 10-356545
Mar. 30, 1999 (JP) ..... 11-89432

(51) Int. Cl.[7] ..... H01J 29/50

(52) U.S. Cl. ..... 313/414; 313/447; 315/381; 315/382

(58) Field of Search ..... 313/441–446, 313/409–417; 315/381, 382, 15

(56) References Cited

U.S. PATENT DOCUMENTS

| | | | | |
|---|---|---|---|---|
| 4,168,452 | A | 9/1979 | Chirtensen et al. | |
| 5,034,653 | A | 7/1991 | Cho et al. | |
| 5,241,240 | A | 8/1993 | Chen et al. | |
| 5,412,277 | A | 5/1995 | Chen | |
| 5,942,843 | A | 8/1999 | Amano et al. | |
| 6,232,711 | B1 * | 5/2001 | Suglyama et al. | 313/414 |

* cited by examiner

*Primary Examiner*—Nimeshkumar D. Patel
*Assistant Examiner*—Mariceli Santiago
(74) *Attorney, Agent, or Firm*—Antonelli, Terry, Stout & Kraus, LLP

(57) ABSTRACT

A color cathode ray tube including a panel section having a phosphor layer formed on an internal surface thereof, a neck portion having an electron gun assembly for emission of three electron beams therein, and a funnel section connecting the panel section and the neck portion. The electron gun assembly includes three cathodes and a plurality of grid electrodes disposed along a tube axis. The grid electrodes includes at least one plate-shaped electrode which has a fixed support structure. The plate-shaped electrode has three bulged portions along an electron beam passage, a first electron beam passage hole being formed in a respective bulged portion and a second electron beam passage being hole formed in a top face portion of a respective bulge portion. A diameter of the first electron beam passage hole is greater than a diameter of the second electron beam passage hole.

9 Claims, 7 Drawing Sheets

CATHODE RAY TUBE

CROSS REFERENCE TO RELATED APPLICATION

This is a continuation of U.S. application Ser. No. 09/460,517, filed Dec. 14, 1999, now U.S. Pat. No. 6,232,711, the subject matter of which is incorporated by reference herein.

BACKGROUND OF THE INVENTION

The present invention relates generally to color cathode ray tubes and, more particularly, to a color cathode ray tube with an in-line type electron gun assembly for emission of a plurality of parallel electron beams extending in one plane.

Color cathode ray tubes, such as television picture tubes and display tubes, are widely employed as visual monitoring devices for use in receiving and displaying over-the-air broadcast TV programs or for use with a variety of types of information processing apparatus or equipment.

Color cathode ray tubes of this type are typically designed to include an evacuated outer envelope structure, which is structured from a panel portion having a fluorescent or phosphor screen formed on its inner surface, a neck portion accommodating therein an electron gun assembly for emission of more than one electron beam, and a cone-shaped portion, also known as a funnel section, for connecting the panel and the neck portion together. And, the electron gun assembly is typically designed to include in-line guns for giving off a plurality of parallel electron beams extending in one plane, i.e. the in-line plane.

FIG. 10 is a side view of an in-line electron gun assembly of the type used in prior art color cathode ray tubes, as seen from the in-line layout direction of electron beams. In FIG. 10, reference numeral "20" designates a cathode; 21 denotes a first grid electrode functioning as a control electrode; and, 22 indicates a second grid electrode acting as an acceleration electrode. The cathode 20, first grid electrode 21 and second grid electrode 22 constitute an electron beam generator unit (triode unit). Numeral 23 denotes a third grid electrode; 24 indicates a fourth grid electrode; 25 denotes a fifth grid electrode; 26 denotes sixth grid electrode; 27 denotes an anode; 28 denotes a shield cup; and 29 denotes a dielectric support structure (multi-foam glass).

Three electron beams as generated by the triode unit consisting of the cathode 20 and first grid electrode 21 and second grid electrode 22 are accelerated and pre-focused by an electron lens system, formed of the third grid electrode 23 and fourth grid electrode 24, as well as the fifth grid electrode 25. Then, the electron beams are focused by a main electron lens, formed of the sixth grid electrode 26 and anode 27, to direct the beams toward the phosphor screen. With the electron gun assembly of this type, the first grid electrode 21 and second grid electrode 22 and fourth grid electrode 24 are each comprised of a plate-shaped electrode, whereas those electrodes (fifth grid electrode 25, sixth grid electrode 26, and anode 27) making up the focusing electron lens and main electron lens are constituted from cup-shaped electrodes.

The third grid electrode 23 has an electron beam passage opening or hole on the side thereof facing the second grid electrode 22, which is less in aperture diameter than an electron beam passage hole on the side thereof facing the fourth grid electrode 24. FIGS. 11A and 11B are a front view and a partially broken sectional view, respectively, of the third grid electrode 23 of FIG. 10. FIG. 11A is a front view of the third grid electrode as viewed from the side facing the second grid electrode, whereas FIG. 11B is a partly broken sectional view from the side.

The third grid electrode 23 consists essentially of two separate electrode components. A first component 231 constituting the third grid electrode is a cup-shaped electrode component having electron beam passage holes 233 of small aperture or bore diameter. A second electrode component 232 making up the third grid electrode 23 is a plate-shaped electrode component having electron beam passage holes 234 greater in bore diameter than the electron beam passage holes 233. The third grid electrode is such that the first component 231 and second component 232 are bonded and soldered together to provide an integral or solid structure. Note that numeral 235 designates tabs to be embedded in the multi-foam glass for supporting the grid electrode.

FIG. 12 depicts a sectional view of the electrode structure as seen along line XII—XII in FIG. 11A. The first component 231 is a cup-shaped component that has three electron beam passage holes 233 on the side facing the second grid electrode 22. The second component 232 is a plate-shaped component having three electron beam passage holes 234 greater in bore diameter than the electron beam passage holes 233. These two components are bonded and soldered together to thereby provide a third grid electrode 23 of solid structure. The aperture or bore diameter Db of the electron beam passage holes 233 on the second grid electrode side as formed in the first component 231 is less than the bore diameter Dt of the electron beam passage holes 234 on the fourth grid electrode side as formed in the second grid electrode 232 (Dd>Dt).

The third grid electrode 23 is thus arranged to employ two components that are soldered together with the center axes of electron beam passage holes of both components being identical to each other. However, the accurate positional alignment between the center axes of the electron beam passage holes of the two separate electrode components remains difficult, which in turn makes it difficult to assemble the third grid electrode with high accuracy. In addition, as respective components (the first component and second component) exhibit their own deviation in the manufacture thereof, the resulting third grid electrode 23 as manufactured by assembly of these components exhibits an even greater deviation. Furthermore, the third grid electrode is located adjacent to the triode unit. Due to such arrangement, minute deformation of the third grid electrode can significantly affect the electron beams that are being emitted.

The first component of the prior art third grid electrode shown in FIG. 12 is designed to have a rise-up portion 240, which is positioned outside of the one side electron beam passage hole in the in-line direction. In other words, the rise-up portion 240 is in close proximity to the side electron beam and yet far from the central electron beam. As a result, the electric field acting on the side electron beam will be different in shape from the electric field acting on the central electron beam. Such a difference between the electric field for the side electron beam and the electric field for the central electron beam in turn causes the central electron beam and the side electron beam to differ from each other in sectional shape also.

FIG. 13 is a process flow diagram for explanation of a manufacturing method of the prior art third grid electrode, which is formed of two components. The first component is formed by press-machining techniques into convex shape; then, three electron beam passage holes are formed in the top surface of the convex component. Barrel processing is then applied to the resultant structure to remove away burrs residing at the electron beam passage holes. The second component is manufactured by a method including the steps of applying press-machining to a plate body to form three electron beam passage holes, and then removing burrs at these electron beam passage holes through barrel processes.

Then, the first component and the second component are bonded with the centers of respective electron beam passage holes in alignment with each other, and the components are then soldered together into an integral or solid structure.

FIG. 14 is a side view of another example of a conventional in-line electron gun module, wherein those parts identified with the same reference numerals correspond to the same functional portions in FIG. 10. With an electron gun unit of this type, the first grid electrode 21 and second grid electrode 22, as well as the third grid electrode 23, are structured from plate-shaped electrodes, whereas those electrodes constituting the focus electron lens and main electron lens (i.e. fifth grid electrode 25, sixth grid electrode 26, and anode 27) are cup-shaped electrodes. The third grid electrode 23 consists of a single unitary plate body, which has three electron beam passage holes.

FIGS. 15A and 15B are a front view and a partly broken side view of the third grid electrode in FIG. 14, wherein FIG. 15A is a plan view as seen from the side facing the second grid electrode, whereas FIG. 15B is a partly broken side view. Press-machining is applied to the unitary electrode component to form therein electron beam passage holes 233, while simultaneously forming tabs 235 at two parallel opposite sides thereof in the in-line direction. A step-like height difference is present between the surface in which the electron beam passage holes 233 are formed and the surface in which the tabs 235 are formed. This step-like difference is provided for preventing the tabs 235 of the third grid electrode 2 and the tabs of the second grid electrode from approaching each other inside of the multi-foam glass support 29.

FIG. 16 is a sectional view of the structure taken along line XVI—XVI in FIG. 15A. Since the electron beam passage holes 233 of the plate-shaped third grid electrode 236 are formed by press-machining techniques, the second grid electrode side and the fourth grid electrode side have the same in bore diameter while the plate thickness (also called "electrode length" or alternatively "along-the-tube-axis-direction length") thereof is at a limited value-typically 1 mm, more or less. Due to this, it is impossible to adequately control the diameter of an electron beam guided to reach the main lens, since the bore diameters of both electron beam passage holes (the hole on the entrance side of electron beam, and hole on the electron beam exit side) are equal.

Since the prior art electron gun units discussed above are designed in such a way that the third grid electrode is comprised of two separate electrode components, it is difficult to achieve the intended position alignment of electron beam passage hole center points between the first component and the second component. Unless such position alignment of the electron beam passage hole center points between the first component and the second component is suitably carried out, the resultant electron beams are likely to deviate in sectional shape.

In addition, it is also difficult to accurately dispose the first component and second component in a parallel fashion, which would easily result in occurrence of focusing degradation. The third grid electrode is a focusing electrode that is located near the triode unit and also is laid out at a location near a cross-over point. This in turn necessitates achievement of high-accuracy manufacturing when compared to the remaining electrodes involved. This is due to the fact that the influence of deformation of the third grid electrode upon the electron beams is more significant than that of the other electrodes upon the electron beams. To be brief, in case the electron beam diameter is minimal at the crossover point, if an electron beam changes in sectional shape at those points in close proximity to the crossover point, then its deformation will become greater at certain locations near or around the main lens at which the electron beam diameter becomes maximized.

Another problem is that the prior art third grid electrode suffers from the need for a significant number of pressing steps and of barrel processes, which in turn leads to increases in complexity of manufacturing procedures. On the other hand, the third grid electrode formed of the prior art unitary plate body is easily manufacturable. However, due to the form of such unitary plate, it is impossible, or at least greatly difficult, to increase the electrode length (length of the cathode ray tube in the direction of the tube axis) thereof. In addition, those electron guns which employ such unitary plate body have encountered a problem in that it is impossible to let electron beam passage holes on the side of neighboring electrodes (the second grid electrode side and fourth grid electrode side) be different in bore diameter from each other.

It is therefore an object of the present invention to avoid the problems inherent in the prior art and to provide an improved color cathode ray tube of high resolution having an electron gun assembly capable of simplified manufacture.

SUMMARY OF THE INVENTION

To attain the foregoing object, the electron gun of a cathode ray tube in accordance with the present invention is specifically arranged so that the third grid electrode consists essentially of a single unitary plate. The third grid electrode is provided with a cylindrical protuberant or bulged portions corresponding to respective ones of the cathode electrodes while forming more than one electron beam passage hole in the top surface of this bulged portion. A certain electron beam passage hole as formed on the side of the third electrode facing the fourth grid electrode may be designed to be greater than the electron beam passage hole on the second grid electrode side thereof.

Furthermore, in order to attain the above object, in accordance with the present invention, the prescribed bulged portion is formed to have a variable profile in such a way that its inner diameter gradually decreases.

DETAILED DESCRIPTION OF THE INVENTION

Figure 1A:
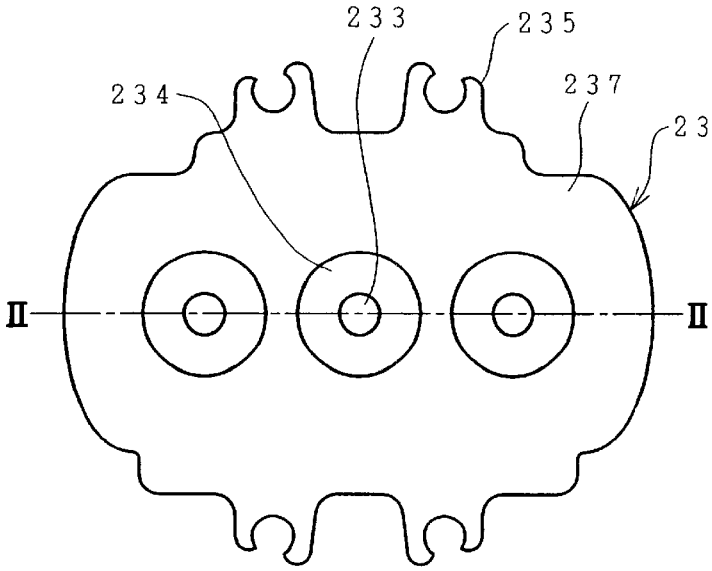
FIG. 1A is a diagram showing a plan view of a third grid electrode of an electron gun assembly adapted for use with a cathode ray tube in accordance with a first embodiment of the present invention, wherein the plan view is of the third grid electrode as seen from the side of the fourth grid electrode.

Some typical arrangements of the present invention will be set forth below.

(1) In a color cathode ray tube having an electron gun assembly including a set of electron guns that are laterally disposed in the so-called in-line configuration for emission of a plurality of electron beams, the electron gun assembly includes an electrode consisting essentially of a single unitary plate body, which electrode has cylindrical bulged portions with a bore diameter Dt corresponding to respective electron beams, wherein each said cylindrical bulged portion has in its top surface an electron beam passage aperture or hole of bore diameter Db, and wherein the diameter Db of said electron beam passage hole and the diameter Dt of said cylindrical bulged portion are determined to satisfy a specific relation of $Dt \geqq Db$.

(2) A curved wall portion is formed at a cylindrical base portion of said bulged portion, which is arranged to have a gradually decreasing inner diameter in a direction toward said top surface.

With such an arrangement of the instant invention, it is possible to freely set up respective bore diameters of an electron beam passage hole on the side of an electron beam entrance side and of an electron beam passage hole on the electron beam exit side. This in turn makes it possible to increase the margins of optimal design of the electron gun assembly, which results in provision of the intended high-quality color cathode ray tube.

A further advantage is that preclusion of any rapid change in entrance or "incoming" of an electric field—this is formed in an interelectrode space relative to a neighboring electrode—into the inside of the bulged portion provides for less resultant spherical aberration, thereby suppressing an increase in beam spot on the phosphor screen, which in turn leads to improvements in resolution.

(3) A ratio (HID) of the bulge height H of said bulged portion and the inner diameter D of the bulged portion in the structural arrangement defined in paragraphs (1) and (2) was determined to fall within a specified range of from 0.3 to 1.0.

It must be noted that the above-noted bulged portions should not be limited only to a complete cylindrical shape and may alternatively be replaced with bulged portions having a substantially trapezoid-like shape in cross-section by way of example. In addition, letting the base of each portion be a curved wall section that gradually decreases in diameter in a direction toward the top face makes it possible to obtain similar results to those described in paragraph (2)—that is, the effect that the entrance of an electric field, as formed between in an interelectrode space relative to a neighboring electrode(s), into the inside of the bulged portion varies moderately (in other words, invasion of electric field components to the inside of the bulged portions will no longer change rapidly).

With the arrangements of the present invention, several advantages are attainable as follows: Positional deviation of those electron beam passage holes formed on both sides of the plate-shaped electrode may be reduced; respective bore diameters of both electron beam passage holes may be freely set up at any desired value; electron gun design margins increase; suppression of the astigmatism makes it possible to obtain images of high resolution; the requisite number of parts or components and the number of fabrication process steps may be decreased; and, a high-quality color cathode ray tube is achievable. Note here that the grid electrode arranged by formation of a unitary plate body as stated above should not be limited only to the third grid electrode, but may alternatively be adapted for other grid electrodes, excluding the cup-shaped electrodes.

One preferred embodiment of the present invention will be explained in more detail with reference to the accompanying drawings.

Figure 1B:
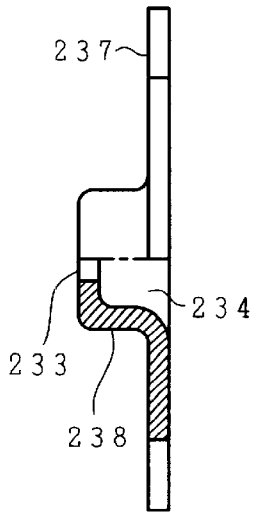
FIG. 1B illustrates a partly broken cross-sectional side view of the electrode shown in FIG. 1A.

FIG. 1 is a diagram of a first embodiment of the third grid electrode of an electron gun assembly adapted for use in the color cathode ray tube in accordance with the invention, wherein FIG. 1A is a plan view as seen from the side of the second grid electrode, and FIG. 1B depicts a side partly sectional view.

The third grid electrode 23 has a unitary plate body 237 with three cylindrical protuberant or bulged portions 238 corresponding to respective electron beams. These bulged portions 238 are designed to project toward the second grid electrode and to have respective top faces (bottom surfaces of bulges 238) in which electron beam passage holes 233 are formed in a way corresponding to respective electron beams.

Figure 2:
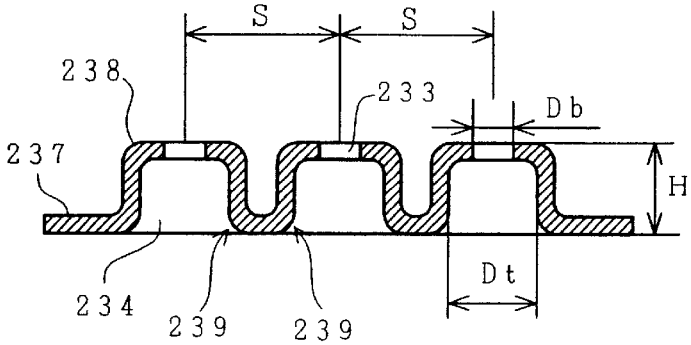
FIG. 2 depicts a sectional view of the electrode of FIG. 1A as seen along line II—II.

FIG. 2 is a sectional view taken along line II—II of FIG. 1A. The electron beam passage holes 233 of bore diameter Db are formed in each of the bulged portions 238. These electron beam passage holes 233 are laid out with a preselected pitch S being defined between neighboring holes. The pitch S is identical to the distance between adjacent ones of the electron beam passage holes of the first grid electrode and also to the distance of a cathode. The bore diameter of the base of each bulged portion 238, i.e. the electron beam passage hole 234 on the side of the fourth grid electrode, is Dt. In the third grid electrode, the bore diameter Db of the electron beam passage hole 233 on the side of the second grid electrode and the bore diameter Dt of the electron beam passage hole on the fourth grid electrode side are determined to satisfy a relation of Dt≧Db. Additionally, the height of such bulged portions (electrode length) is H.

Preferably, the plate thickness of a plate body 237 constituting the third grid electrode 23 is set in a range from 0.4 mm to 0.7 mm. With this plate thickness value range setting, it is possible to achieve good process press work machining. If the plate thickness is less than 0.4 mm, then the bulged portions 238 will possibly be cut in the side walls thereof. Recommendably, the electrode length H of the third grid electrode 23 may be set in a range from 1.25 mm to 3 mm. If the electrode length H of the third grid electrode 23 is less than 1.25 mm, then the electron lens action due to the electron beam passage hole 234 will become weaker. If the electrode length H of the third grid electrode 23 is greater than 3 mm, then a focusing voltage being applied to a focusing electrode must become higher in potential, which would result in the voltage being undesirably increased beyond the withstand voltage capacitance of the stem pins, leading to the risk of an undesired discharge between such stem pins.

The bore diameter Db of the electron beam passage holes 233 in the top face of the bulged portions 238 of the third grid electrode 23 is preferably determined to fall within a range of 0.5 mm to 2 mm. Designing the bore diameter Db to fall in a range from 0.5 to 2 min enables the electron beams to be focused in a good condition. If the bore diameter Db is less than 0.5, then the resulting electron beam, when reaching the main lens, becomes smaller in diameter, which causes it to pass through the center point of the main lens. Hence, the focal point of such electron beam becomes far from the main lens, which in turn provides for an insufficient focusing of the light on the phosphor plane. Alternatively, in cases where it is focused in a desired way, while setting the bore diameter Db at values less than 0.5, the fifth grid electrode must be lengthened. If the fifth electrode is made longer, then the resulting components or required materials increase in number, which will disadvantageously cause a problem in that the whole length of the cathode tube of interest becomes longer. In addition, if the bore diameter Db increases beyond 2 mm, then the resultant electron beam becomes too large in diameter, thus causing the astigmatism to increase accordingly.

It will be preferable for the bore diameter Dt of the electron beam passage hole 234 of the third grid electrode 23 on the side of the fourth grid electrode to be less than or equal to ⅔ of the electron beam distance or interval (S size). Letting the bore diameter Dt be less than or equal to ⅔ of the electron beam distance permits a planar portion to be formed between neighboring bulged portions 238, which would result in a decrease in distortion of the electric field within the electron beam passage hole 234. More preferably, the bore diameter Dt may be set in a range from 3 mm to 4.4 mm.

Practically, the plate thickness of the unitary plate body 237 was set at 0.5 mm, the electrode length H was 2 mm, the bore diameter Db of the electron beam passage holes 233 de-fined in the top faces of bulged portions 238 was 1.5 mm, and the bore diameter Dt of the electron beam passage holes 234 on the side of the fourth grid electrode was 3.5 mm. Evaluation of a color cathode ray tube employing such an election gun assembly has revealed the fact that excellent focusing of the electron beams was obtained as compared to prior art color cathode ray tubes.

These electron beam passage holes 233 and 234 are provided such that it is possible to readily set up the sizes Dt, Db and H under the relation of D≧Db. Accordingly, margins for optimal design of the electron gun unit becomes greater. Also note that irrespective of the fact that the third grid electrode is structured from a unitary plate, the bore diameter of those electron beam passage holes on the side of the second grid electrode and the bore diameter of electron beam passage holes on the fourth grid electrode side are different from each other. With this structure, it is possible to readily control the electron beam diameter of the electron beams reaching the main lens. It is also possible to suppress any possible distortion of the electron beam cross-sectional shape. In other words, the present invention is capable of obtaining a color cathode ray tube with enhanced focusability.

And, a ratio (H/Dt) of the bore diameter Dt of an electron beam passage hole 234 at the base of bulged portion 238 relative to the height H of such bulge is determined to fall within a range of 0.3 to 1.0. Setup of 0.3≦H/Dt≦0.1 makes it possible to suppress the amount of change of an electric field being formed inside of the bulged portion 238, thereby enabling reduction of astigmatism. The basis for designing this ratio (H/Dt) to fall in a range from 0.3 to 1.0 is as follows: The above setup values are obtained through evaluation of an operation of a color cathode ray tube that was assembled by use of an electron gun module fabricated using actually manufactured electrodes.

Further, at the base of such bulged portion 238, a curved wall portion is formed at the inner wall thereof (edge portion of an electron beam passage hole 234 opposing its neighboring electrode) whose inner diameter gradually decreases. This curved wall portion is formed by providing a curved wall portion 239 with a certain curvature at the inner wall edge in the case of this bulged portion 238. Forming such a curved portion 239 makes it possible to increase the bore diameter of the base of the bulged portion (aperture diameter of electron beam passage hole). As a result, any change of electric field components becomes moderate when an electric field being formed in an interelectrode space relative to a neighboring electrode(s) behaves to enters or "invade" the inside of the bulged portion from the electron beam passage hole 234. Due to this, any possible astigmatism of an electron lens decreases, which lens is formed by the electron beam passage hole 234, including the base of this bulged portion 238. As a result, the present invention is characterized in that the resultant beam spot on the phosphor screen decreases in diameter, thus enabling obtainment of a color cathode ray tube which is capable of visually displaying images of high resolution.

Since the bulged portion 238 is formed in a manner corresponding to each electron beam, the electric fields acting on respective electron beams will be formed similarly to one another. Hence, the sectional shape of each electron beam will no longer be distorted in any way. In other words, it is possible to render the sectional shape of the side electron beams and that of the central electron beam identical to each other. In addition, because a single bulged portion 238 is formed per electron beam, it is also possible to change or modify the sectional shape of each electron beam as necessity requires.

Figure 3:
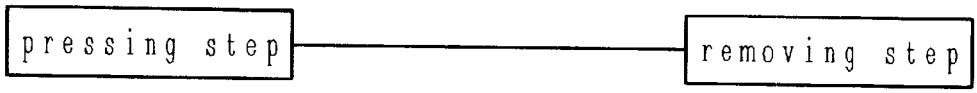
FIG. 3 is a process flow diagram for explanation of a manufacturing method of the electrode of the instant invention.

FIG. 3 is a process flow diagram for explanation of a method of manufacturing the plate-shaped electrode of the illustrative embodiment. In this embodiment, two different kinds of press fabrication steps are carried out in a press-machining procedure.

Firstly, one unitary plate body is press-formed to thereby manufacture through press-machining the intended cylindrical bulged portions (first pressing). The first pressing results in the plate body forming three bulged portions corresponding to three electron beams. The bulged portions 238 stand up vertically from the plate body, thereby letting the top face be substantially parallel to the plate body. The bore diameter Dt of a "root" portion (base) of such stand-up portion raised from the plate body and the height H of such bulged portion are controlled to have appropriate dimensions as required.

Next, electron beam passage holes are formed at the top faces. The electron beam passage holes are formed by die-punching techniques through press-machining (second pressing). The bore diameter Db of each hole which has been formed by the second pressing is controlled to have appropriate dimensions as required. Since the bore diameter Db of electron beam passage hole 233 is less than the bore diameter Dt of electron beam passage hole 234, a plane as folded from the rise-up portion (face substantially parallel to the plate body) is left in the top face. Optionally, the electron beam passage holes may be defined by use of techniques other than press-machining.

After completion of the press-machining, a barrel process is performed. At the barrel process step, burrs present on the electrode components are removed.

Figure 4A:
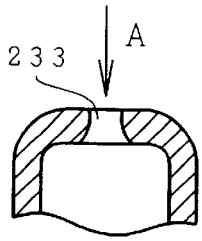
FIGS. 4A and 4B are sectional diagrams each showing an electron beam passage hole as formed in the top face of a bulged portion.
Figure 4B:
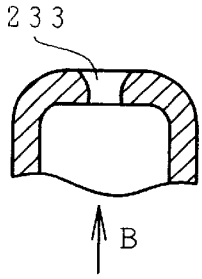

FIGS. 4A and 4B are diagram showing examples is of a method for forming electron beam passage holes at the top faces of bulged portions. Fabrication of these electron beam passage holes 233 may be done simultaneously during press-machining of the bulged portions; or alternatively, the process may be modified so that hole-defining pressing is carried out after having formed the bulged portions by press-machining techniques. Forming such electron beam passage hole 233 may be done in a direction as indicated by the arrow "A" from outside of the bulged portion as shown in FIG. 4A; or, alternatively, it may be in a direction as indicated by arrow B from inside of the bulged portion as shown in FIG. 4B.

After completion of the pressing process, burrs generated at the electron beam passage holes 233 at such process step are removed. If the electron beam passage holes 233 are formed from the direction indicated in FIG. 4B, then burrs occur at portions outside of the bulged portion. As burrs occur outside of the bulged portion, the requisite burr removal performed during the barrel process becomes easier.

FIGS. 5A to 5E are diagrams showing different examples of the planar shape of electron beam passage holes being formed at the top faces of bulged portions along with a layout pattern thereof.

Figure 5A:
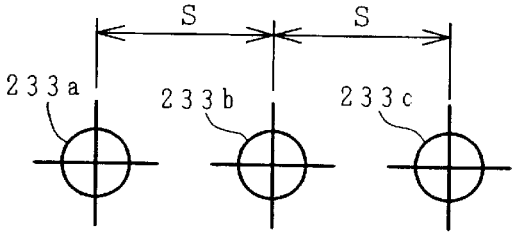
FIGS. 5A including and up to 5E are diagrams showing respective examples of the planar shape and layout of electron beam passage holes formed in the top face of the bulged portion.

Three separate electron beam passage holes 233*a* (side beam penetration hole), 233*b* (center beam penetration hole), and 233*c* (side beam penetration hole) of FIG. 5A were disposed at the pitch S. All the electron beam passage holes 233*a*, 233*b*, 233*c* are of circular shape in cross-section.

Figure 5D:
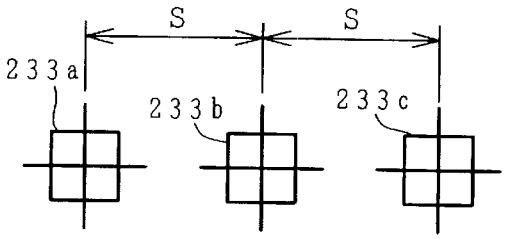
Figure 5B:
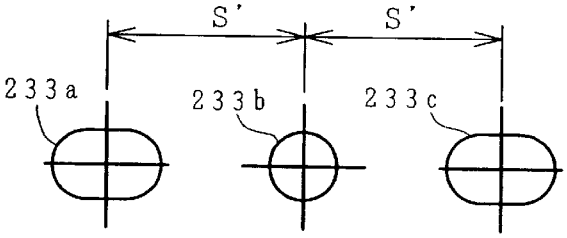

Electron beam passage holes 233*a*, 233*b*, 233*c* of FIG. 5B were laid out in such a manner that the center points thereof are aligned in the in-line direction at a pitch S'. The center point of each of the side electron beam passage holes is offset leftwardly from the center points of the first grid electrode and cathode. The side electron beam passage holes are of elliptic shape in profile.

Figure 5E:
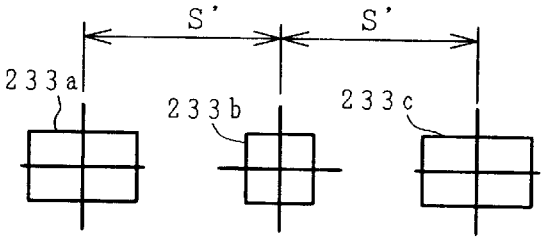
Figure 5C:
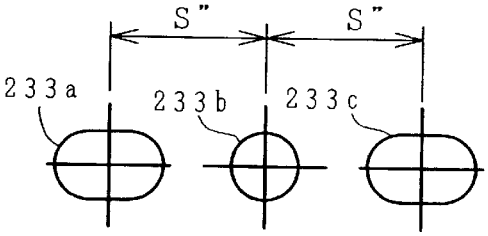

Three separate electron beam passage holes 233*a*, 233*b*, and 233*c* of FIG. 5C were disposed so that the center points of side electron beam passage holes 233*a* and 233*c* are aligned in the in-line direction at a pitch S". The center of each of the side electron beam passage holes is offset toward the side of the center electron beam side (inwardly) from the center points of the first grid electrode and cathode. The side electron beam passage holes are of elliptic shape.

Three electron beam passage holes 233*a*, 233*b*, and 233*c* of FIG. 5D were disposed at the pitch S. All the electron beam passage holes 233*a*, 233*b*, 233*c* are of rectangular shape.

Electron beam passage holes 233*a*, 233*b*, 233*c* of FIG. 5E were laid out such that the center points thereof are aligned in the in-line direction at a pitch S'. The center of each of the side electron beam passage holes is offset outwardly from the center points of the first grid electrode and cathode. The side electron beam passage holes are of rectangular shape having their long axis extending in the in-line direction.

Letting the center points of the side electron beam passage holes 233*a*, 233*c* be offset outwardly makes it possible to change the orbit of an electron beam.

The third grid electrode 23 of FIG. 5A or FIG. 5D is formed such that the distance (pitch) of the center axes of either the bulged portions 238 or electron beam passage holes 234 is S. The third grid electrode 23 of FIG. 5B or FIG. 5E is formed such that the center-axis distance (pitch) of either the bulged portions 238 or electron beam passage holes 234 is S', which is identical to the pitch of the electron beam passage holes 233. The third grid electrode 23 of FIG. 5C is formed such that the center-axis distance (pitch) of either the bulged portions 238 or electron beam passage holes 234 is S', which is identical to the pitch of the electron beam passage holes 233.

While any one of the exemplary layout patterns of three electron beam passage holes 233*a*, 233*b*, 233*c* shown in FIGS. 5A to 5E are usable, the FIG. 5A example was employed in this embodiment.

Figure 6:
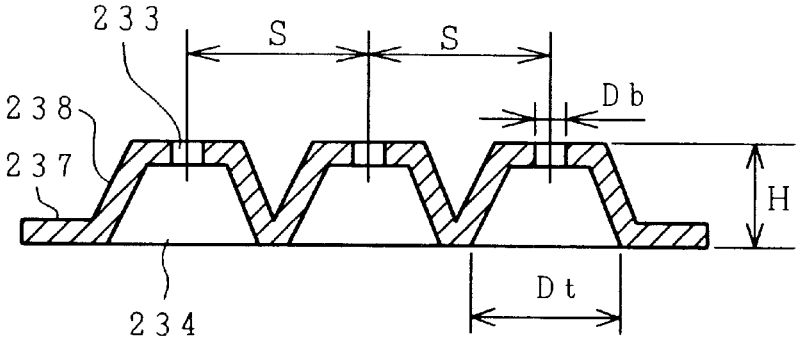
FIG. 6 is a diagram showing a sectional view along an in-line direction of the third grid electrode of the electron gun assembly adapted for use with the cathode ray tube in accordance with the first embodiment of the invention.

FIG. 6 is a sectional diagram for explanation of a second embodiment of the third grid electrode of an electron gun module which is adaptable for use in a color cathode ray tube in accordance with the invention. In this embodiment, the cylindrical bulged portions 238 are modified into almost a trapezoidal shape. With such an arrangement, a change in electric field entering from the side of neighboring electrodes becomes moderate, thereby enabling reduction of astigmatism due to the fact that a large-diameter aperture (electron beam passage hole) 234 of bulged portion 238 gradually decreases in diameter toward a direction of an opening (electron beam passage hole) 233 that is defined in the top face of such bulged portion 238.

It is noted that, where necessary, a similar curved wall portion to that shown in FIG. 2 may be formed at the inner wall edge of the electron beam passage hole 234. Respective size relations of the bulged portions in this embodiment are the same as those in the embodiment of FIG. 2. With the illustrative embodiment also, it is possible to obtain a color cathode ray tube capable of displaying high resolution images.

Figure 7:
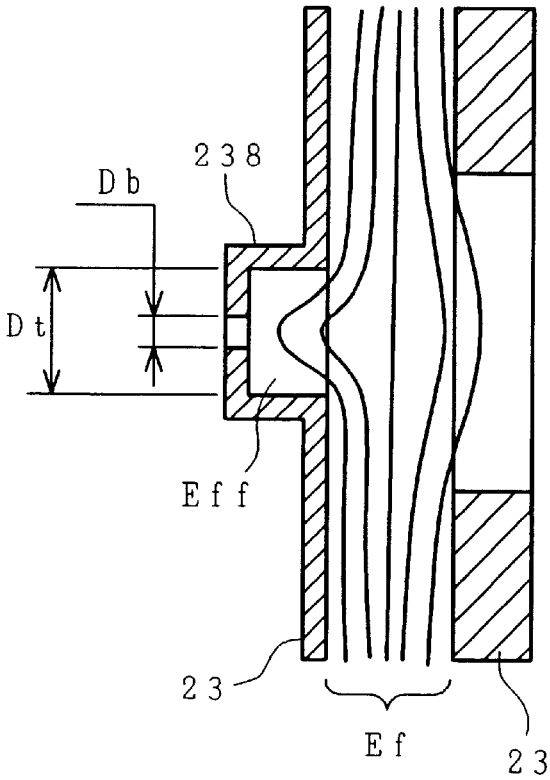
FIG. 7 is a diagram showing a representation of an electric field as created in a plate-shaped electrode with a bulged portion formed thereat.

FIG. 7 depicts an electric field as formed by the fourth grid electrode and the third grid electrode. More specifically, FIG. 7 is a pictorial diagram for explanation of the generation of astigmatism at a plate-shaped electrode structured from one unitary plate body with a bulged portion formed thereon. The fourth grid electrode 24 and third grid electrode 23 constitute a pre-stage focusing electron lens.

Part of an electric field Ef as formed between the plate-shaped electrode 23 with a cylindrical bulged portion 238 formed therein and its neighboring electrode 24 behaves so as to enter or "invade" inside of the bulged portion 238. Since the base of such bulged portion 238 stands up, the electric field Eff intrudes into the electron beam passage hole 234. This electric field Eff has the function of focusing an electron beam or beams. The pre-stage focus electron lens functions to focus an electron beam that inherently attempts to expand or spread, thereby letting it have a suitable electron beam diameter for introduction to the main lens. The resultant electron beam focused by the pre-stage focus electron lens is further focused by the main lens for projection onto the phosphor screen.

Figure 8:
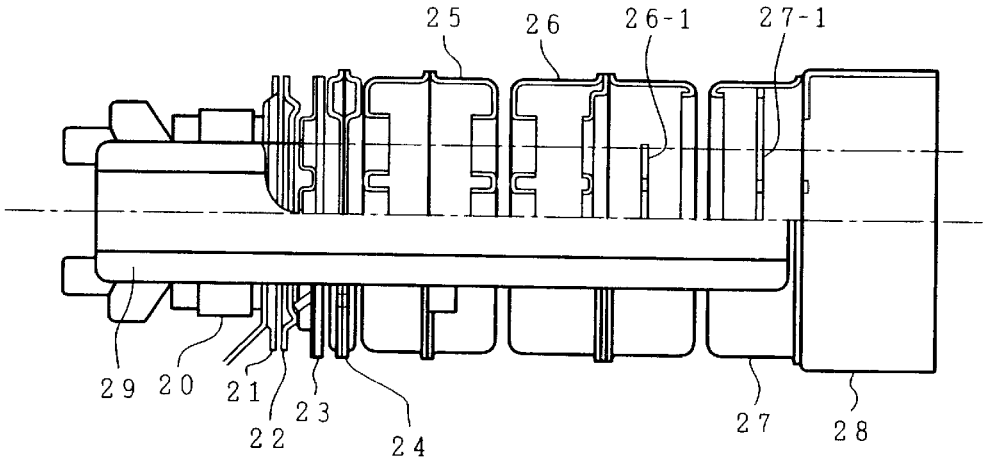
FIG. 8 is a partly broken side view of an in-line electron gun assembly for use with the color cathode ray tube of the invention.

FIG. 8 is a partly broken sectional view of an electron gun assembly as used in the color cathode ray tube of the present invention. This electron gun unit is arranged to include a cathode 20, first grid electrode (accelerator electrode) 21, second grid electrode (control electrode) 22, third grid electrode 23, fourth grid electrode 24, fifth grid electrode 25, sixth grid electrode 26, and anode (seventh grid electrode) 27, which components are laid out and secured along with a multi-foam glass 29 into a prespecified layout. Additionally, numeral 28 designates a shield cup. A voltage of approximately 20 to 200V is applied to the cathode; a voltage of about 0 V is applied to the first grid electrode; a voltage of about 500 to 1 kV is applied to the second grid electrode and fourth grid electrode; and, a voltage of 20 to 30 kV is applied to the anode. In addition, a focusing voltage of about 5 to 10 kV is applied to the third grid electrode and fifth grid electrode.

The third grid electrode 23 is formed such that the bore diameter of an electron beam passage hole on the side of the second grid electrode 22 is less than the bore diameter of an electron beam passage hole on the fourth grid electrode 24 side. The fifth grid electrode 25 and sixth grid electrode 26 are focusing electrodes. The sixth grid electrode 26 internally has an opening for permitting penetration of an electron beam of the center with a correction electrode plate 26-1 installed therein, which plate is arranged to allow side electron beams to pass therethrough in association with a cup-shaped electrode inner wall. In addition, a correction electrode plate 27-1 is installed within the sixth grid electrode 27 acting as the anode, which plate is to allow penetration of three electron beams.

Figure 9:
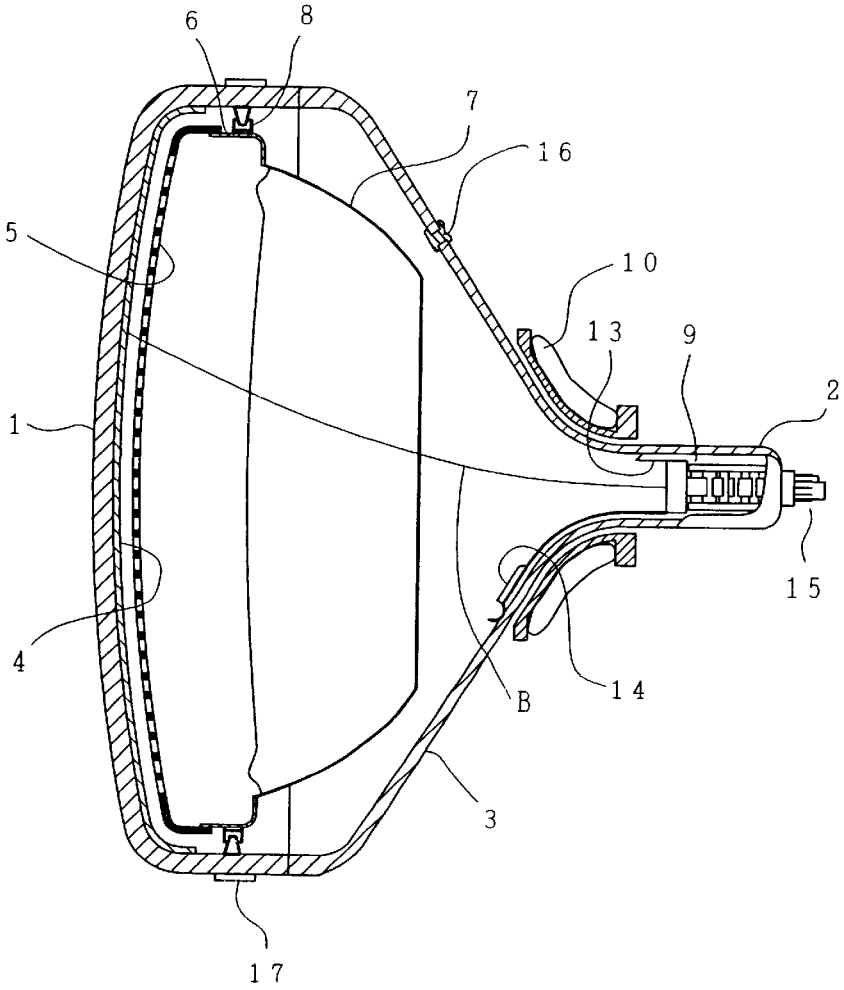
FIG. 9 is a sectional view along the axis direction showing the overall structure of a color cathode ray tube embodying the invention.
Figure 10:
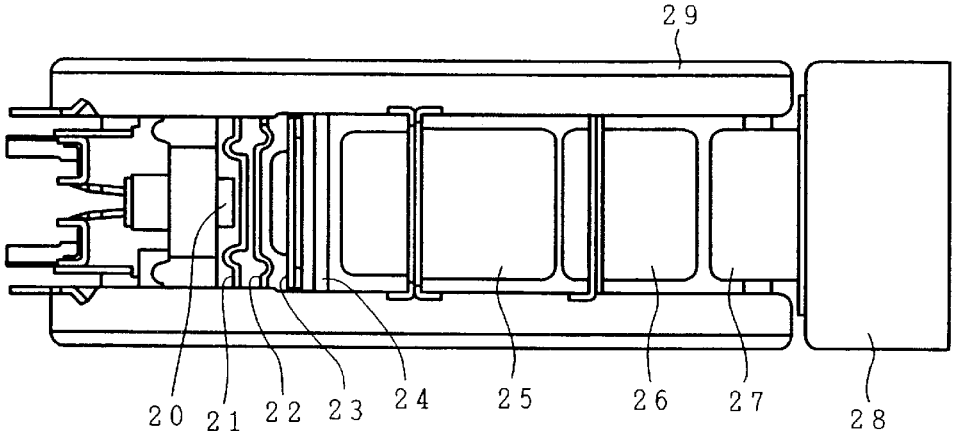
FIG. 10 (Prior Art)
FIG. 10 is a side view of one typical prior known electron gun assembly.
Figure 11A:
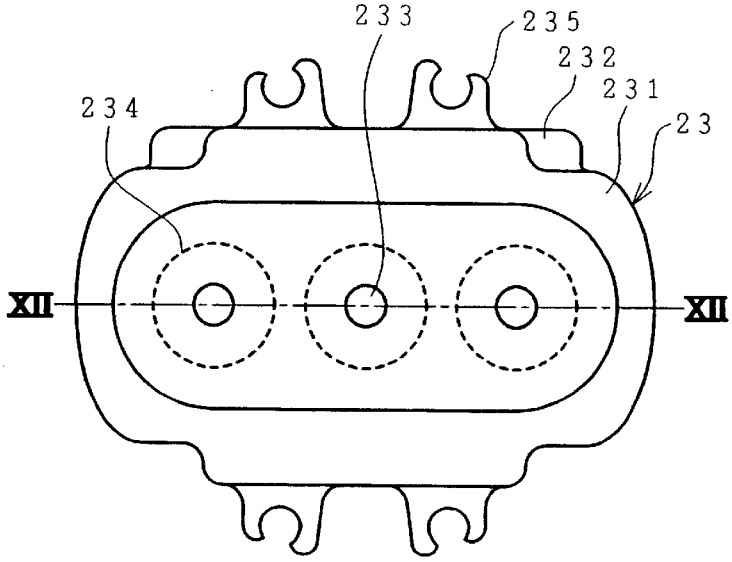
FIG. 11A (Prior Art)
FIG. 11A is a front view of a third grid electrode in the prior art.
Figure 11B:
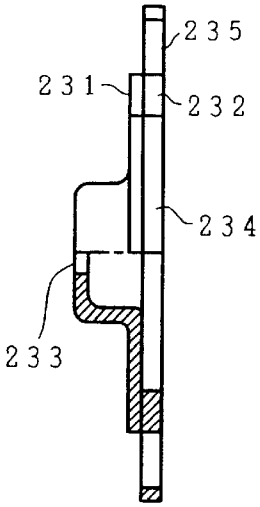
FIG. 11B (Prior Art)
FIG. 11B is a partially broken side view of the electrode of FIG. 11A.
Figure 12:
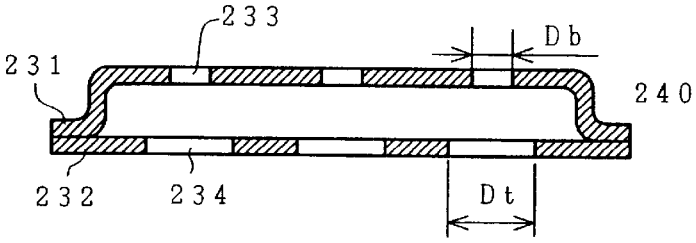
FIG. 12 (Prior Art)
FIG. 12 is a sectional view of the electrode taken along line XII—XII in FIG. 11A.
Figure 13:
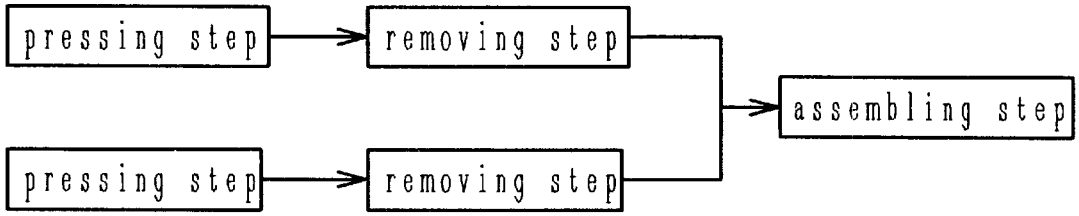
FIG. 13 (Prior Art)
FIG. 13 is a schematical process flow diagram of a manufacturing method of a prior art electrode using two components.
Figure 14:
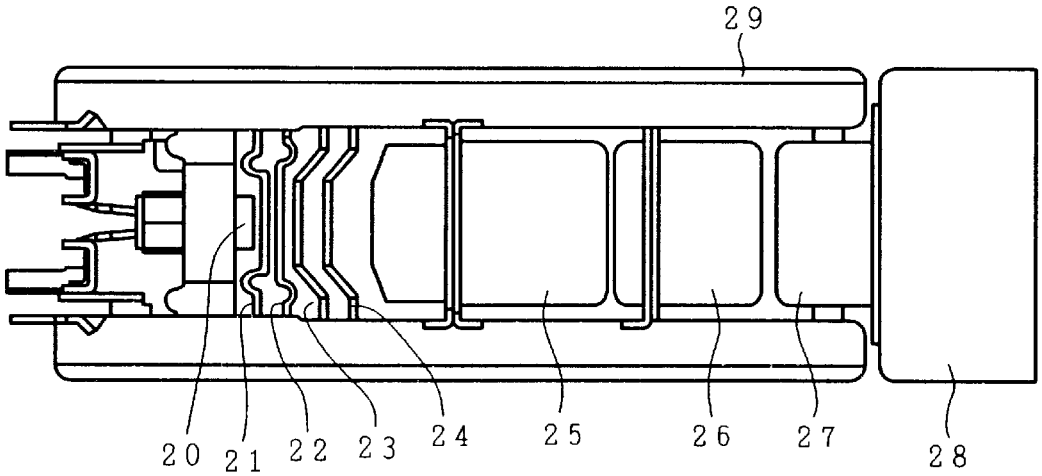
FIG. 14 (Prior Art)
FIG. 14 is a side view of another prior art electron gun assembly.
Figure 15A:
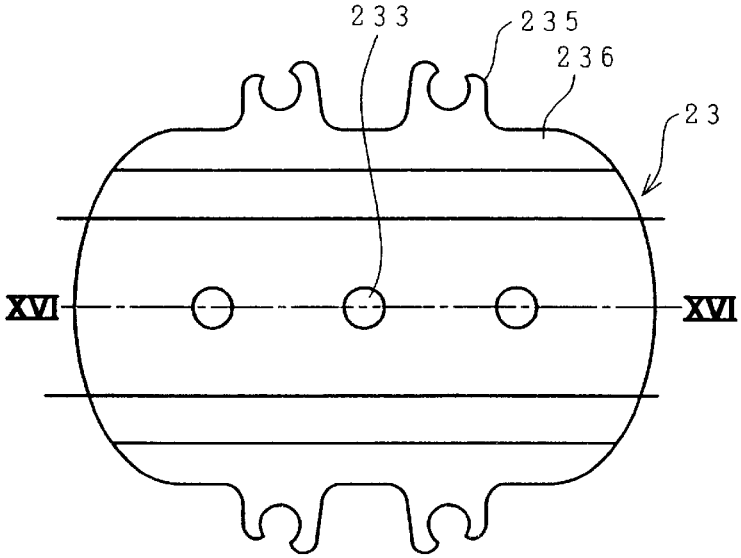
FIG. 15A (Prior Art)
FIG. 15A is a diagram showing a front view of a still another third grid electrode.
Figure 15B:
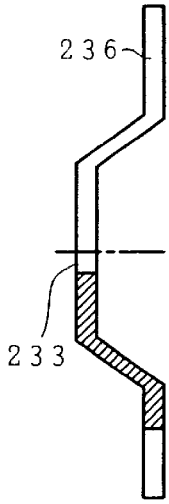
FIG. 15B (Prior Art)
FIG. 15B is a partly broken sectional view of FIG. 14A.
Figure 16:
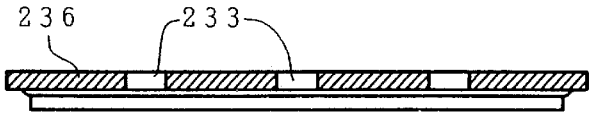
FIG. 16 (Prior Art)
FIG. 16 is a sectional view of FIG. 15A taken along line XVI—XVI.

FIG. 9 is a sectional view along the tube axis showing the overall structure of the color cathode ray tube in accordance with the invention. Numeral 1 designates a panel section; 2 denotes a neck portion; 3 indicates a cone-shaped funnel section; 4 denotes a phosphor plane; 5 denotes a shadow-mask; 6 denotes a mask frame; 7 denotes a magnetic shield; 8 denotes a shadow-mask suspension mechanism; 9 denotes an in-line electron gun unit; 10 denotes a deflection yoke; 11 denotes an inner conductive layer as formed inside of the funnel; 12 denotes an outer conductive layer formed outside of the funnel; 13 denotes a contact spring for use in supplying an anode voltage to the electron gun unit; 14 denotes a getter; 15 denotes a stem for supplying the electron gun with a variety of kinds of voltages, including but not limited to image signals; 16 denotes an anode terminal; and 17 denotes a tension band.

This color cathode ray tube is arranged so that its evacuated outer envelope or vacuum vessel consists essentially of the panel section 1 and neck portion 2, plus the funnel section 3 for connecting the panel section 1 and neck portion 2 together. The panel section 1 has a skirt portion that is rigidly clamped by the tension band 17 provided around the periphery thereof. And, the panel section 1 has, on its inner surface, a phosphor plane 4 formed with chosen fluorescent materials of three primary colors—red, blue and green—in a stripe pattern or dot pattern to thereby constitute the phosphor screen.

The in-line electron gun module mounted inside of the redneck portion 2 is operable to emit three separate electron beams that extend in one plane, i.e. the in-line plane. A color selection electrode (shadow mask) 5 having grids of either multiple apertures or regularly spaced parallel linear stripes is disposed in close proximity to the phosphor plane 4. Reference character "B" is used to generally indicate the three electron beams. The deflection yoke 10 is externally mounted in a transition region between the funnel section 3 and neck portion 2.

The electron gun unit 9 is supplied by the contact spring 13 with an anode voltage from the anode terminal 16 formed at the funnel section 3 via the inner conductive layer 11. Three electron beams B emitted from the electron gun unit 9 and aligned with an in-line layout are deflected to two different directions, namely horizontal and vertical directions, due to the presence of a vertical deflection magnetic field and horizontal magnetic field created by the deflection yoke 10. The electron beams receive color selection at the shadow mask 5 and are then guided to hit respective fluorescent materials that form the phosphor plane 4 to thereby form a full color image.

With this color cathode ray tube, it is possible to obtain an even more excellent focusability as compared to traditional color cathode ray tubes, which in turn makes it possible to display color images of high resolution.

It should be noted that according to the invention, designing the third grid electrode constituting its electron gun assembly to have a specific shape with bulged portions machined in a unitary plate body enables the both (electron beam entrance side and electron beam exit side) electron beam passage holes to be different in aperture diameter from each other. This in turn makes it possible to reduce or minimize the risk of any possible astigmatism, while at the same time permitting the electrode length thereof to substantially increase. Needless to say, the present invention should not he limited to this, and may alternatively be applied to other plate-shaped electrodes required to offer the same or similar functionality; still alternatively, the invention should not be applied exclusively to an electron gun assembly of the color cathode ray tube that has been illustrated in FIG. 9.

It has been described that the present invention is capable of attaining several effects and advantages including, but not limited to, an ability to let both electron beam passage holes of the plate-shaped electrode consisting essentially of a unitary plate body be different in diameter from each other, an ability to increase the electrode length, an ability to moderate a change in electric field at each electron beam passage hole, an ability to reduce astigmatism, and an ability to achieve improvements in the focusing characteristics due to enlargement of the optimal design range. A further advantage of the invention is that the intended grid electrode of any desired electrode length is obtainable by use of a single component, which in turn makes it possible to easily manufacture such a color cathode ray tube. Furthermore, it is possible to reduce production costs of the color cathode ray tube.

What is claimed is:

1. A color cathode ray tube comprising:

a panel section having a phosphor layer formed on an internal surface thereof, a neck portion having an electron gun assembly for emission of three electron beams therein, and a funnel section connecting the panel section and the neck portion;

the electron gun assembly including three cathodes and a plurality of grid electrodes disposed along a tube axis, the plurality of grid electrodes including at least one plate-shaped electrode with a fixed support structure;

the plate-shaped electrode having three bulged portions along an electron beam passage, each of the three bulged portions including a base and a top face portion, a first electron beam passage hole being formed in a respective base of the three bulged portions, and a second electron beam passage hole being formed in a respective top face portion of top face portion of the three bulged portions; and a diameter of the first electron beam passage hole being greater than a diameter of the second electron beam passage hole.

2. The color cathode ray tube according to claim 1, wherein the respective base of the three bulged portions includes a side wall portion which is elongated from a plate body to the top face portion to form the first electron beam passage hole, a diameter of the second electron beam passage hole being gradually decreased.

3. The color cathode ray tube according to claim 1, wherein a ratio (H/Dt) of a height H of the bulged portion to an inner diameter Dt thereof falls within a range of 0.3 to 1.0.

4. The color cathode ray tube according to claim 1, wherein a focusing voltage is applied to the plate-shaped electrode.

5. A color cathode ray tube comprising:

a panel section having a phosphor layer formed on an internal surface thereof, a neck portion having an electron gun assembly for emission of three electron beams therein, and a funnel section connecting the panel section and the neck portion;

the electron gun assembly including three cathodes, a first grid electrode, a second grid electrode, a third grid electrode facing the second grid electrode, and an anode electrode; and the third grid electrode being a shaped unitary plate having three bulged portions, each of the three bulged portions including a base and a top portion, a first electron beam passage hole being provided in a respective base of the three bulged portions and located at the anode side, and a second electron beam passage hole facing the second grid electrode and formed on a respective top face portion of the three bulged portions.

6. The color cathode ray tube according to claim 5, wherein a diameter of the first electron beam passage hole is greater than a diameter of the second electron beam passage hole.

7. The color cathode ray tube according to claim 5, wherein the respective base of the three bulged portions includes a side wall portion which is elongated from a plate body to the top face portion to form the first electron beam passage hole, wherein a diameter of the second electron beam passage hole being gradually decrease.

8. The color cathode ray tube according to claim 5, wherein a ratio (H/Dt) of a height H of the bulged portion to an inner diameter Dt thereof falls within a range of 0.3 to 1.0.

9. The color cathode ray tube according to claim 5, wherein a focusing voltage is applied to the third grid electrode.

* * * * *